US011713741B2

(12) United States Patent
Yagai et al.

(10) Patent No.: US 11,713,741 B2
(45) Date of Patent: Aug. 1, 2023

(54) FUEL SUPPLY PUMP

(71) Applicant: HITACHI ASTEMO, LTD., Hitachinaka (JP)

(72) Inventors: Masamichi Yagai, Hitachinaka (JP); Kiyotaka Ogura, Hitachinaka (JP); Shingo Tamura, Hitachinaka (JP); Yuto Ishizuka, Hitachinaka (JP); Hiroyuki Yamada, Hitachinaka (JP); Kenichiro Tokuo, Hitachinaka (JP); Minoru Hashida, Hitachinaka (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 0 days.

(21) Appl. No.: 17/775,778

(22) PCT Filed: Oct. 30, 2020

(86) PCT No.: PCT/JP2020/040759

§ 371 (c)(1),
(2) Date: May 10, 2022

(87) PCT Pub. No.: WO2021/095556

PCT Pub. Date: May 20, 2021

(65) Prior Publication Data

US 2022/0381213 A1 Dec. 1, 2022

(30) Foreign Application Priority Data

Nov. 13, 2019 (JP) ..... 2019-205606

(51) Int. Cl.
*F02M 59/46* (2006.01)
*F02M 63/00* (2006.01)

(52) U.S. Cl.
CPC ..... *F02M 59/46* (2013.01); *F02M 59/462* (2013.01); *F02M 63/0036* (2013.01)

(58) Field of Classification Search
CPC ... F02M 59/46; F02M 59/462; F02M 63/0036
(Continued)

(56) References Cited

U.S. PATENT DOCUMENTS

2005/0205065 A1* 9/2005 Rembold ..... F16K 17/0406 123/446

FOREIGN PATENT DOCUMENTS

DE 102014212646 A1 * 10/2015 ..... F02M 59/462
EP 1411238 A1 * 4/2004 ..... F02M 55/04
(Continued)

OTHER PUBLICATIONS

DE102014212631A1 (Sebastian et al.) (Oct. 15, 2015) (Machine Translation) (Year: 2015).*
(Continued)

*Primary Examiner* — Mahmoud Gimie
(74) *Attorney, Agent, or Firm* — Foley & Lardner LLP

(57) ABSTRACT

Provided is a fuel supply pump capable of improving welding quality while securing a function of a valve body. A fuel supply pump of the present invention includes a regulating member (discharge valve stopper 84) that guides movement of a valve body (discharge valve 82), a main body portion (body 1) provided with a valve chamber (discharge valve chamber 1*d*) that houses the regulating member, a sealing member (plug 85) that seals the valve chamber, and a welded portion (welded portion 86) that fixes the sealing member to the main body portion. An annular space portion (annular space portion 60) along an outer periphery of the regulating member is formed between the welded portion and the regulating member. The regulating member includes a positioning portion (fitting portion 84*a*) for positioning with respect to the main body portion on a side opposite to the sealing member, and a gap forming portion (gap forming portion 84*c*) forming an annular gap (annular gap 63)
(Continued)

between the gap forming portion and the main body portion, and the annular gap allows a space on a side of the positioning portion in the valve chamber and the annular space portion to communicate with each other.

14 Claims, 6 Drawing Sheets

(58) Field of Classification Search
USPC ..... 123/446
See application file for complete search history.

(56) References Cited

FOREIGN PATENT DOCUMENTS

| | | | |
|---|---|---|---|
| JP | 2016-044664 | A | 4/2016 |
| JP | 2017-072026 | A | 4/2017 |
| JP | 2018-100651 | A | 6/2018 |
| JP | 2019-143562 | A | 8/2019 |

OTHER PUBLICATIONS

EP1411238A1 (Helmut et al.) (Apr. 21, 2004) (Machine Translation) (Year: 2004).*
International Search Report with English translation and Written Opinion issued in corresponding application No. PCT/JP2020/040759 dated Dec. 28, 2020.
English translation of JP2016-044664A, 40 pages.
English translation of the Office Action issued by the German Patent Office dated Jul. 20, 2022 for corresponding German Patent Application No. 10 2020 004 456.4, 7 pages.
Office Action issued by the German Patent Office dated Jul. 20, 2022 for corresponding German Patent Application No. 10 2020 004 456.4, 8 pages.

* cited by examiner

FUEL SUPPLY PUMP

TECHNICAL FIELD

The present invention relates to a fuel supply pump.

BACKGROUND ART

In the related art, a high-pressure fuel supply pump that pressure-feeds a fuel to a fuel injection valve of an internal combustion engine has been known.

This high-pressure fuel supply pump is described in, for example, PTL 1. A high-pressure fuel supply pump described in PTL 1 includes a valve mechanism having a valve body that opens and closes a flow path and a facing portion that faces the valve body in a valve body axial direction. The facing portion is formed of a small-diameter portion and a large-diameter portion, and the small-diameter portion constitutes a guide member that guides the valve body and a support portion that supports the guide member.

The support portion is press-fitted and held by a plug joined to the outer peripheral portion of a pump body using a welded portion, and the plug closes a space in which the valve mechanism is disposed.

CITATION LIST

Patent Literature

PTL 1: JP 2018-100651 A

SUMMARY OF INVENTION

Technical Problem

However, in a high-pressure fuel supply pump described in PTL 1, a gap is formed between a pump body and a plug and on the back side of the welded portion. Since the gap is a closed space formed by the close contact between the pump body and the plug, the air expanded due to the influence of the heat at the time of welding pushes out the welded portion to generate an underfill, and thus, strength of the welded portion may not be secured.

In view of the above problems, an object of the present invention is to provide a fuel supply pump capable of improving welding quality while securing a function of a valve body.

Solution to Problem

In order to solve the above problems and achieve the object of the present invention, a fuel supply pump of the present invention includes a regulating member that guides movement of a valve body or regulates a movement distance of the valve body, a main body portion provided with a valve chamber that houses the regulating member, a sealing member that seals the valve chamber, and a welded portion that fixes the sealing member to the main body portion. An annular space portion along an outer periphery of the regulating member may be formed between the welded portion and the regulating member. The regulating member includes a positioning portion for positioning with respect to the main body portion on a side opposite to the sealing member, and a gap forming portion forming an annular gap between the gap forming portion and the main body portion, and the annular gap allows a space on a side of the positioning portion in the valve chamber and the annular space portion to communicate with each other.

Advantageous Effects of Invention

According to the fuel supply pump having the above configuration, it is possible to improve the quality of welding while securing the function of the valve body.

Objects, configurations, and effects other than those described above will be clarified by the following descriptions of embodiments.

DESCRIPTION OF EMBODIMENTS

1. First Embodiment

Figure 1:
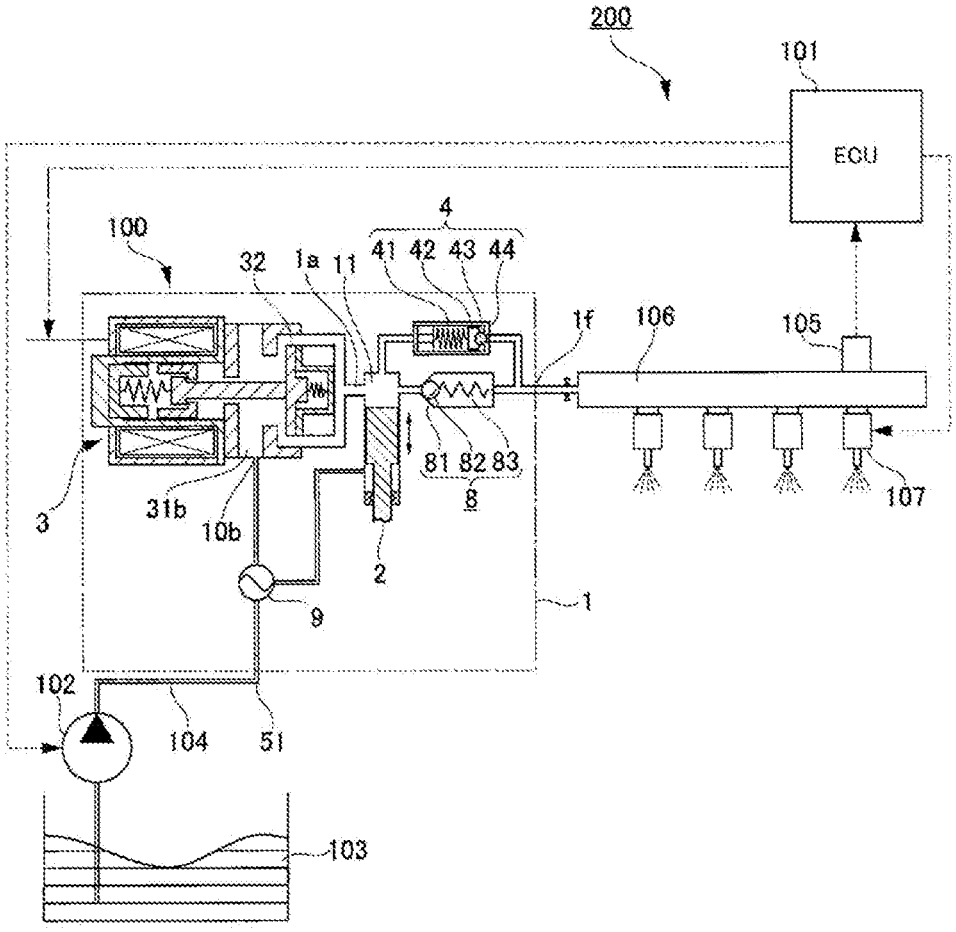
FIG. 1 is an overall configuration diagram of a fuel supply system using a high-pressure fuel supply pump according to a first embodiment of the present invention.

Hereinafter, a high-pressure fuel supply pump according to a first embodiment of the present invention will be described. Common members in each drawing are represented by the same reference numerals.

[Fuel Supply System]

First, a fuel supply system using a high-pressure fuel supply pump according to the present embodiment will be described with reference to FIG. 1.

FIG. 1 is an overall configuration diagram of the fuel supply system using the high-pressure fuel supply pump according to the present embodiment.

As illustrated in FIG. 1, a fuel supply system 200 includes a high-pressure fuel supply pump 100, an engine control unit (ECU) 101, a fuel tank 103, a common rail 106, and a plurality of injectors 107. Components of the high-pressure fuel supply pump 100 are integrally incorporated in a body 1.

A fuel in the fuel tank 103 is pumped up by a feed pump 102 that is driven based on a signal from the ECU 101. The pumped fuel is pressurized to an appropriate pressure by a pressure regulator (not illustrated) and sent to a low-pressure fuel suction port 51 of the high-pressure fuel supply pump 100 through a low-pressure pipe 104.

The high-pressure fuel supply pump 100 pressurizes the fuel supplied from the fuel tank 103 and pressure-feeds the fuel to the common rail 106. The plurality of injectors 107 and a fuel pressure sensor 105 are mounted on the common rail 106. The plurality of injectors 107 is mounted in accordance with the number of cylinders (combustion chambers), and injects the fuel according to a drive current output from the ECU 101. The fuel supply system 200 of the present embodiment is a so-called direct injection engine system in which the injector 107 directly injects fuel into a cylinder of the engine.

The fuel pressure sensor 105 outputs the detected pressure data to the ECU 101. The ECU 101 calculates an appropriate injection fuel amount (target injection fuel length), an appropriate fuel pressure (target fuel pressure), and the like based on engine state quantities (for example, a crank rotation angle, a throttle opening, an engine speed, a fuel pressure, and the like) obtained from various sensors.

In addition, the ECU 101 controls driving of the high-pressure fuel supply pump 100 and the plurality of injectors 107 on the basis of a calculation result of the fuel pressure (target fuel pressure) or the like. That is, the ECU 101 includes a pump control unit that controls the high-pressure fuel supply pump 100 and an injector control unit that controls the injector 107.

The high-pressure fuel supply pump 100 includes a pressure pulsation reduction mechanism 9, an electromagnetic suction valve mechanism 3 which is a variable capacity mechanism, a relief valve mechanism 4, and a discharge valve mechanism 8. The fuel flowing from the low-pressure fuel suction port 51 reaches a suction port 31*b* of the electromagnetic suction valve mechanism 3 via the pressure pulsation reduction mechanism 9 and a suction passage 10*b*.

The fuel flowing into the electromagnetic suction valve mechanism 3 passes through a suction valve 32, flows through a suction passage 1*a* formed in the body 1, and then flows into a pressurizing chamber 11. A plunger 2 is slidably held in the pressurizing chamber 11. The plunger 2 reciprocates when power is transmitted by a cam 91 (refer to FIG. 2) of the engine.

In the pressurizing chamber 11, fuel is sucked from the electromagnetic suction valve mechanism 3 in a downward stroke of the plunger 2, and the fuel is pressurized in an upward stroke. When the fuel pressure in the pressurizing chamber 11 exceeds a set value, the discharge valve mechanism 8 is opened, and the high-pressure fuel is pressure-fed to the common rail 106 via a discharge passage 1*f*. The fuel discharge by the high-pressure fuel supply pump 100 is operated by opening and closing the electromagnetic suction valve mechanism 3. The opening and closing of the electromagnetic suction valve mechanism 3 is controlled by the ECU 101.

In a case where an abnormal high pressure occurs in the common rail 106 or the like due to a failure of the injector 107 or the like, when a differential pressure between a fuel discharge port 12*a* (see FIG. 2) communicating with the common rail 106 and the pressurizing chamber 11 becomes equal to or more than a valve opening pressure of the relief valve mechanism 4, the relief valve mechanism 4 opens. As a result, the fuel having the abnormally high pressure is returned to the pressurizing chamber 11 through the relief valve mechanism 4, and the pipes such as the common rail 106 are protected.

[High-Pressure Fuel Supply Pump]

Next, a configuration of the high-pressure fuel supply pump 100 will be described with reference to FIGS. 2 to 4.

Figure 2:
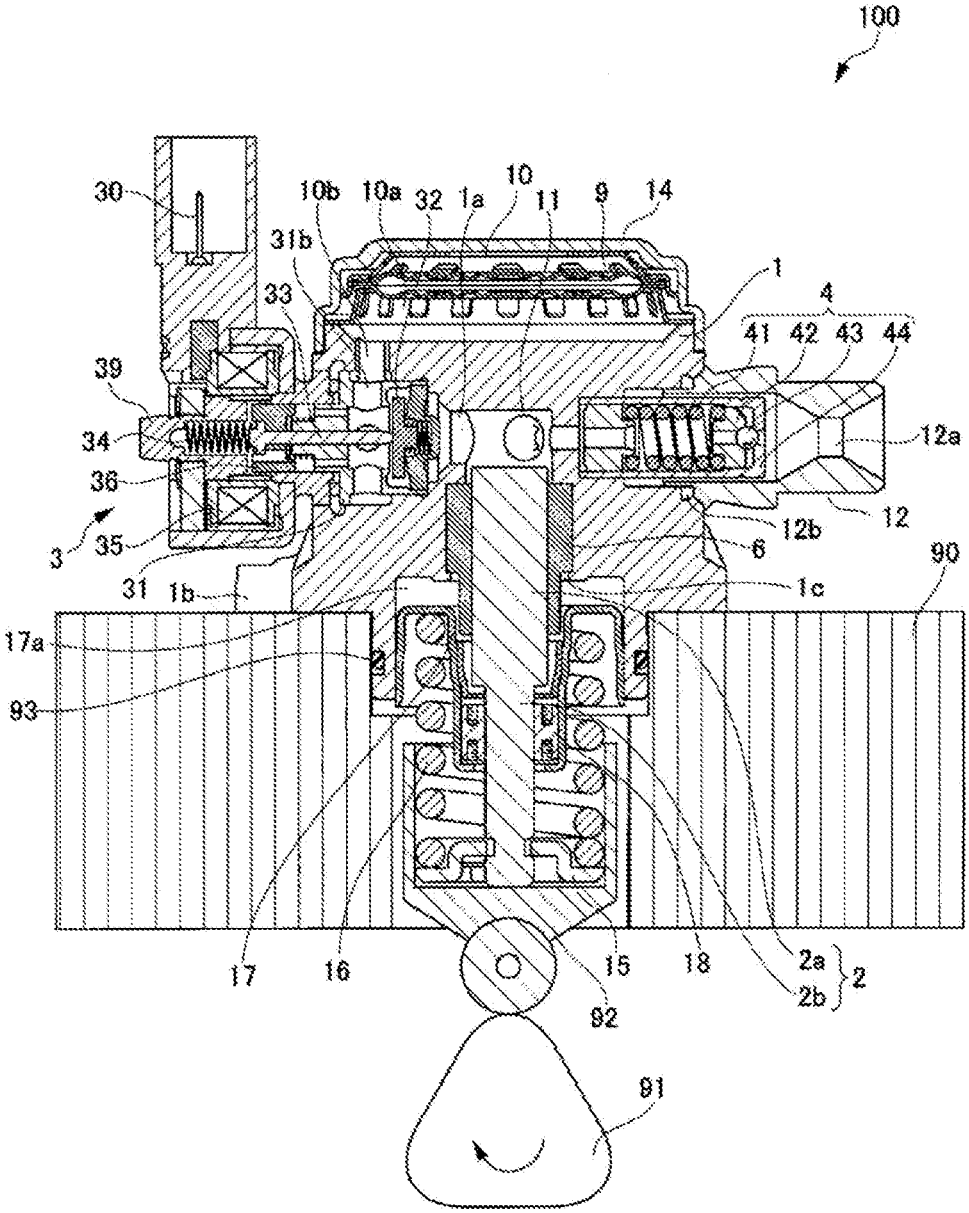
FIG. 2 is a longitudinal cross-sectional view of the high-pressure fuel supply pump according to the first embodiment of the present invention.

FIG. 2 is a longitudinal cross-sectional view of the high-pressure fuel supply pump 100 as viewed in a cross section orthogonal to a horizontal direction. FIG. 3 is a horizontal cross-sectional view of the high-pressure fuel supply pump 100 as viewed in a cross section orthogonal to a vertical direction.

Figure 3:
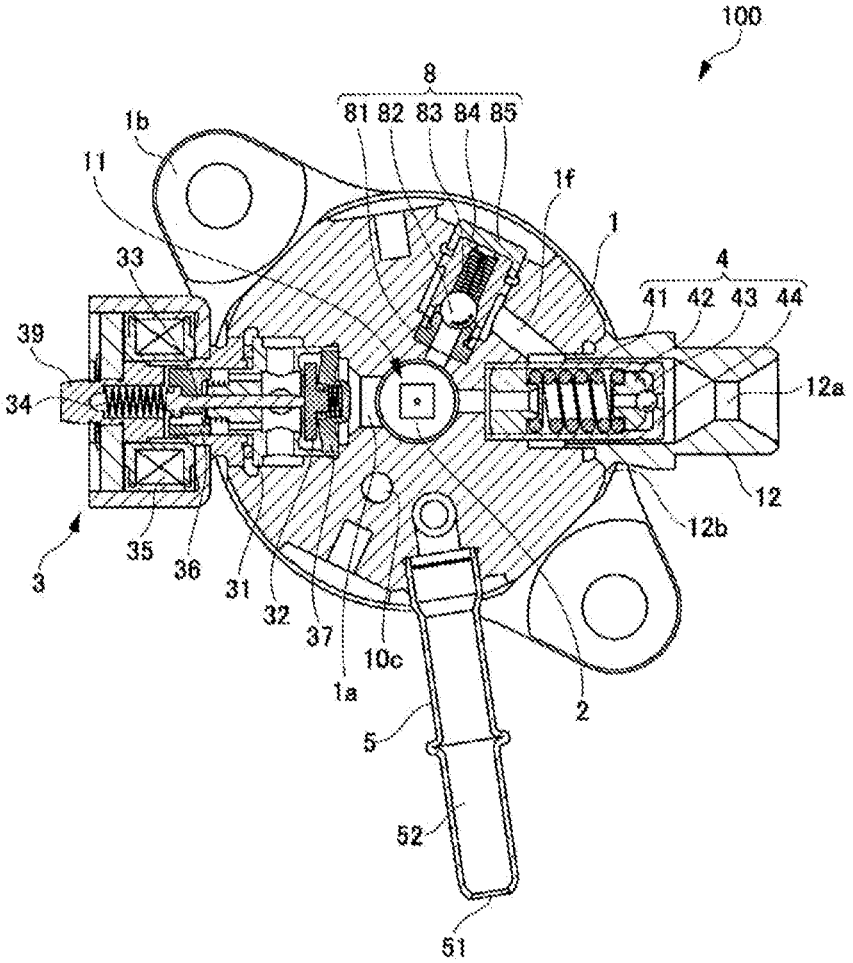
FIG. 3 is a horizontal cross-sectional view of the high-pressure fuel supply pump according to the first embodiment of the present invention as viewed from above.

As illustrated in FIGS. 2 and 3, the body 1 of the high-pressure fuel supply pump 100 is provided with the above-described suction passage 1*a* and an attachment flange 1*b*. The attachment flange 1*b* is in close contact with a fuel pump attachment portion 90 of an engine (internal combustion engine) and is fixed by a plurality of bolts (screws) (not illustrated). That is, the high-pressure fuel supply pump 100 is fixed to the fuel pump attachment portion 90 by the attachment flange 1*b*.

As shown in FIG. 2, an O-ring 93 showing a specific example of a seat member is interposed between the fuel pump attachment portion 90 and the body 1. The O-ring 93 prevents engine oil from leaking to the outside of the engine (internal combustion engine) through between the fuel pump attachment portion 90 and the body 1.

A cylinder 6 that guides the reciprocating motion of the plunger 2 is attached to the body 1 of the high-pressure fuel supply pump 100. The cylinder 6 is formed in a tubular shape, and is press-fitted into the body 1 on the outer peripheral side thereof. The body 1 and the cylinder 6 form the pressurizing chamber 11 together with the electromagnetic suction valve mechanism 3, the plunger 2, and the discharge valve mechanism 8 (see FIG. 4).

The body 1 is provided with a fixing portion 1*c* that engages with a central portion of the cylinder 6 in an axial direction. The fixing portion 1*c* of the body 1 presses the cylinder 6 upward (upward in FIG. 2) so that the fuel pressurized in the pressurizing chamber 11 does not leak from between an upper end surface of the cylinder 6 and the body 1.

A lower end of the plunger 2 is provided with a tappet 92 that converts rotational motion of a cam 91 attached to a cam shaft of the engine into vertical motion and transmits the vertical motion to the plunger 2. The plunger 2 is biased toward the cam 91 side by a spring 16 via a retainer 15, and is crimped to the tappet 92. The tappet 92 reciprocates with the rotation of the cam 91. The plunger 2 reciprocates together with the tappet 92 to change the volume of the pressurizing chamber 11.

A seal holder 17 is disposed between the cylinder 6 and the retainer 15. The seal holder 17 is formed in a tubular shape into which the plunger 2 is inserted, and has an auxiliary chamber 17*a* at an upper end portion on the cylinder 6 side. In addition, the seal holder 17 holds a plunger seal 18 at a lower end portion on the retainer 15 side.

The plunger seal 18 is slidably in contact with the outer periphery of the plunger 2, and seals the fuel in the auxiliary chamber 17*a* when the plunger 2 reciprocates so that the fuel in the auxiliary chamber 17*a* does not flow into the engine. The plunger seal 18 prevents lubricating oil (including engine oil) that lubricates a sliding portion in the engine from flowing into the body 1.

In FIG. 2, the plunger 2 reciprocates in an up-down direction. When the plunger 2 is lowered, the volume of the pressurizing chamber 11 increases, and when the plunger 2 is raised, the volume of the pressurizing chamber 11 decreases. That is, the plunger 2 is disposed to reciprocate in a direction of enlarging and reducing the volume of the pressurizing chamber 11.

The plunger 2 has a large-diameter portion 2*a* and a small-diameter portion 2*b*. When the plunger 2 reciprocates, the large-diameter portion 2*a* and the small-diameter portion 2*b* are located in the auxiliary chamber 17*a*. Therefore, the volume of the auxiliary chamber 17*a* increases or decreases by the reciprocation of the plunger 2.

The auxiliary chamber 17*a* communicates with a low-pressure fuel chamber 10 through a fuel passage 10*c* (see FIG. 3). When the plunger 2 is lowered, the fuel flows from the auxiliary chamber 17*a* to the low-pressure fuel chamber 10, and when the plunger 2 is raised, the fuel flows from the low-pressure fuel chamber 10 to the auxiliary chamber 17*a*. As a result, a flow rate of the fuel into and out of the pump in an intake stroke or a return stroke of the high-pressure fuel supply pump 100 can be reduced, and pressure pulsation generated in the high-pressure fuel supply pump 100 can be reduced.

The body 1 is provided with the relief valve mechanism 4 communicating with the pressurizing chamber 11. The relief valve mechanism 4 includes a relief spring 41, a relief valve holder 42, a relief valve 43, and a seat member 44. One end portion of the relief spring 41 abuts on the body 1, and the other end portion abuts on the relief valve holder 42. The relief valve holder 42 is engaged with the relief valve 43, and a biasing force of the relief spring 41 acts on the relief valve 43 via the relief valve holder 42.

The relief valve 43 is pressed by the biasing force of the relief spring 41 to close the fuel passage of the seat member 44. The fuel passage of the seat member 44 communicates with the discharge passage 1*f*. Movement of fuel between the pressurizing chamber 11 (upstream side) and the seat member 44 (downstream side) is blocked by contact (close contact) of the relief valve 43 with the seat member 44.

When the pressure in the common rail 106 or a member before the common rail increases, the fuel on the seat member 44 side presses the relief valve 43 to move the relief valve 43 against the biasing force of the relief spring 41. As a result, the relief valve 43 is opened, and the fuel in the discharge passage 1*f* returns to the pressurizing chamber 11 through the fuel passage of the seat member 44. Therefore, the pressure for opening the relief valve 43 is determined by the biasing force of the relief spring 41.

The relief valve mechanism 4 of the present embodiment communicates with the pressurizing chamber 11, but is not limited thereto. For example, the relief valve mechanism 4 may communicate with a low-pressure passage (low-pressure fuel suction port 51, suction passage 10*b*, or the like).

As illustrated in FIG. 3, a suction joint 5 is attached to a side surface portion of the body 1. The suction joint 5 is connected to the low-pressure pipe 104 through which the fuel supplied from the fuel tank 103 passes. The fuel in the fuel tank 103 is supplied from the suction joint 5 to the inside of the high-pressure fuel supply pump 100.

The suction joint 5 includes the low-pressure fuel suction port 51 connected to the low-pressure pipe 104 and an suction flow path 52 communicating with the low-pressure fuel suction port 51. The fuel that has passed through the suction flow path 52 reaches the suction port 31*b* (see FIG. 2) of the electromagnetic suction valve mechanism 3 via the pressure pulsation reduction mechanism 9 and the suction passage 10*b* (see FIG. 2) provided in the low-pressure fuel chamber 10. A suction filter (not illustrated) is disposed in the suction flow path 52. The suction filter removes foreign substances present in the fuel and prevents foreign substances from entering the high-pressure fuel supply pump 100.

As illustrated in FIG. 2, the body 1 of the high-pressure fuel supply pump 100 is provided with the low-pressure fuel chamber 10. The low-pressure fuel chamber 10 is covered with a damper cover 14. The low-pressure fuel chamber 10 is provided with a low-pressure fuel flow path 10*a* and the suction passage 10*b*. The suction passage 10*b* communicates with the suction port 31*b* (see FIG. 2) of the electromagnetic suction valve mechanism 3, and the fuel passing through the low-pressure fuel flow path 10*a* reaches the suction port 31*b* of the electromagnetic suction valve mechanism 3 via the suction passage 10*b*.

The pressure pulsation reduction mechanism 9 is provided in the low-pressure fuel flow path 10*a*. When the fuel flowing into the pressurizing chamber 11 is returned to the suction passage 10*b* (see FIG. 2) through the electromagnetic suction valve mechanism 3 in the valve opening state again, pressure pulsation occurs in the low-pressure fuel chamber 10. The pressure pulsation reduction mechanism 9 reduces spreading of the pressure pulsation generated in the high-pressure fuel supply pump 100 to the low-pressure pipe 104.

The pressure pulsation reduction mechanism 9 is formed of a metal diaphragm damper in which two corrugated disk-shaped metal plates are bonded to each other at the outer peripheries thereof, and an inert gas such as argon is injected into the metal diaphragm damper. The metal diaphragm damper of the pressure pulsation reduction mechanism 9 expands and contracts to absorb or reduce pressure pulsation.

(Electromagnetic Suction Valve Mechanism)

Next, the electromagnetic suction valve mechanism 3 will be described with reference to FIG. 4.

Figure 4:
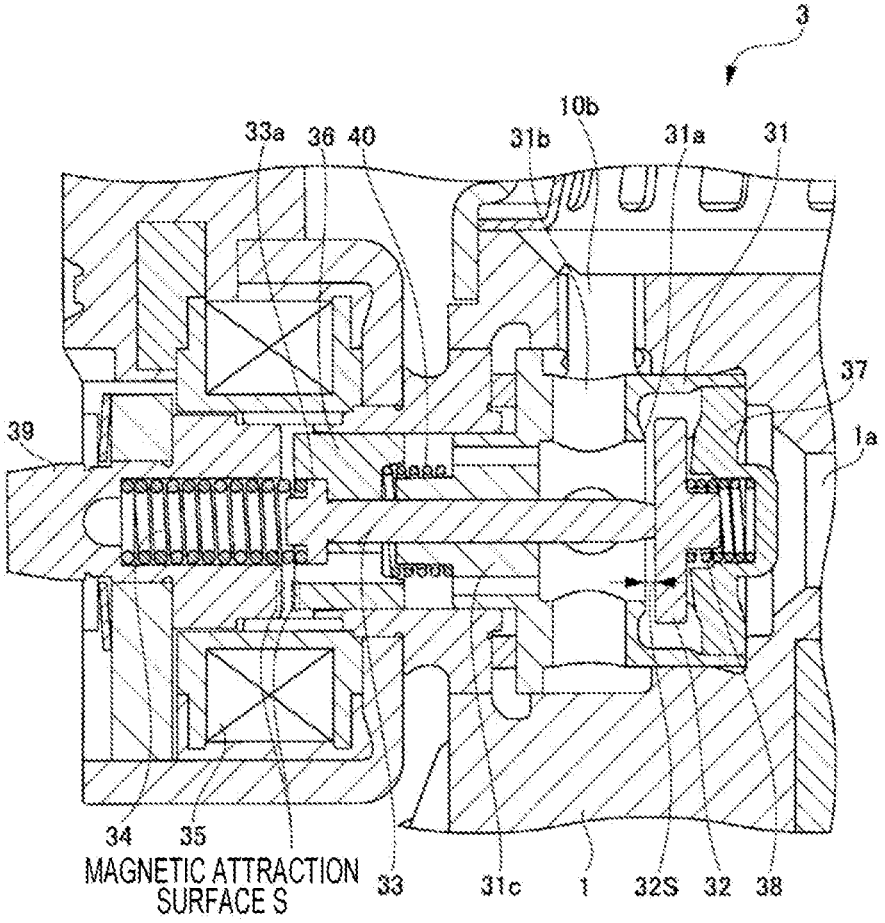
FIG. 4 is an enlarged longitudinal cross-sectional view of the electromagnetic suction valve mechanism of the high-pressure fuel supply pump according to the first embodiment of the present invention, and illustrates a valve opening state of an electromagnetic suction valve.

FIG. 4 is an enlarged longitudinal cross-sectional view of the electromagnetic suction valve mechanism 3 of the high-pressure fuel supply pump 100, and illustrates a valve opening state of the electromagnetic suction valve mechanism 3.

As illustrated in FIG. 4, the electromagnetic suction valve mechanism 3 is inserted into a lateral hole formed in the body 1. The electromagnetic suction valve mechanism 3 includes a suction valve seat 31 press-fitted into a lateral hole formed in the body 1, a suction valve 32, a rod 33, a rod biasing spring 34, an electromagnetic coil 35, and an anchor 36.

The suction valve seat 31 is formed in a tubular shape, and a seating portion 31*a* is provided on an inner peripheral portion. The suction port 31*b* that reaches the inner peripheral portion from the outer peripheral portion is formed in the suction valve seat 31. The suction port 31*b* communicates with the suction passage 10*b* in the low-pressure fuel chamber 10 described above.

A stopper 37 facing the seating portion 31*a* of the suction valve seat 31 is disposed in the lateral hole formed in the body 1, and the suction valve 32 is disposed between the stopper 37 and the seating portion 31*a*. A valve biasing spring 38 is interposed between the stopper 37 and the suction valve 32. The valve biasing spring 38 biases the suction valve 32 toward the seating portion 31*a* side.

The suction valve 32 abuts on the seating portion 31*a* to close the communicating portion between the suction port 31*b* and the pressurizing chamber 11, and the electromagnetic suction valve mechanism 3 is closed. Meanwhile, when the suction valve 32 abuts on the stopper 37, the communicating portion between the suction port 31*b* and the pressurizing chamber 11 is opened, and the electromagnetic suction valve mechanism 3 is opened.

The rod 33 penetrates the rod guide 31*c* of the suction valve seat 31, and one end of the road abuts on the suction valve 32. The rod biasing spring 34 biases the suction valve 32 in a valve opening direction which is the stopper 37 side via the rod 33. One end of the rod biasing spring 34 is engaged with the other end of the rod 33, and the other end of the rod biasing spring 34 is engaged with a magnetic core 39 disposed so as to surround the rod biasing spring 34.

The anchor 36 faces an end surface of the magnetic core 39. The anchor 36 is engaged with a flange 33*a* provided on the outer peripheral portion of the rod 33. One end of an anchor biasing spring 40 abuts on the side of the anchor 36 opposite to the magnetic core 39. The other end of the anchor biasing spring 40 abuts on the rod guide 31*c*. The anchor biasing spring 40 biases the anchor 36 toward the flange 33*a* of the rod 33. A movement amount of the anchor 36 is set to be larger than a movement amount of the suction valve 32. As a result, the suction valve 32 can reliably abut on (be reliably seated on) the seating portion 31*a*, and the electromagnetic suction valve mechanism 3 can be reliably brought into a valve closing state.

The electromagnetic coil 35 is disposed around the magnetic core 39. A terminal member 30 (see FIG. 2) is electrically connected to the electromagnetic coil 35, and a current flows through the terminal member 30. In a non-energized state in which no current flows through the electromagnetic coil 35, the rod 33 is biased in the valve opening direction by the biasing force of the rod biasing spring 34, and presses the suction valve 32 in the valve opening direction. As a result, the suction valve 32 is separated from the seating portion 31*a* and abuts on the stopper 37, and the electromagnetic suction valve mechanism is in the valve opening state. That is, the electromagnetic suction valve mechanism 3 is a normally open type valve mechanism that opens in a non-energized state.

In the valve opening state of the electromagnetic suction valve mechanism 3, the fuel in the suction port 31*b* passes between the suction valve 32 and the seating portion 31*a*, and flows into the pressurizing chamber 11 through a plurality of fuel passing holes (not illustrated) of the stopper 37 and the suction passage 1*a*. In the valve opening state of the electromagnetic suction valve mechanism 3, the suction valve 32 comes into contact with the stopper 37, so that the position of the suction valve 32 in the valve opening direction is restricted. The gap existing between the suction valve 32 and the seating portion 31*a* in the valve opening state of the electromagnetic suction valve mechanism 3 is a movable range of the suction valve 32, which is a valve opening stroke 32S.

When a current flows through the electromagnetic coil 35, a magnetic attraction force acts on a magnetic attraction surfaces S of each of the anchor 36 and the magnetic core 39. That is, the anchor 36 is attracted to the magnetic core 39. As a result, the anchor 36 moves against the biasing force of the rod biasing spring 34 and comes into contact with the magnetic core 39. When the anchor 36 moves in a valve closing direction on the magnetic core 39 side, the rod 33 with which the anchor 36 engages moves together with the anchor 36. As a result, the suction valve 32 is released from the biasing force in the valve opening direction, and moves in the valve closing direction by the biasing force of the valve biasing spring 38. When the suction valve 32 comes into contact with the seating portion 31*a* of the suction valve seat 31, the electromagnetic suction valve mechanism 3 is closed.

(Discharge Valve Mechanism)

Next, the discharge valve mechanism 8 will be described with reference to FIGS. 3 and 5.

Figure 5:
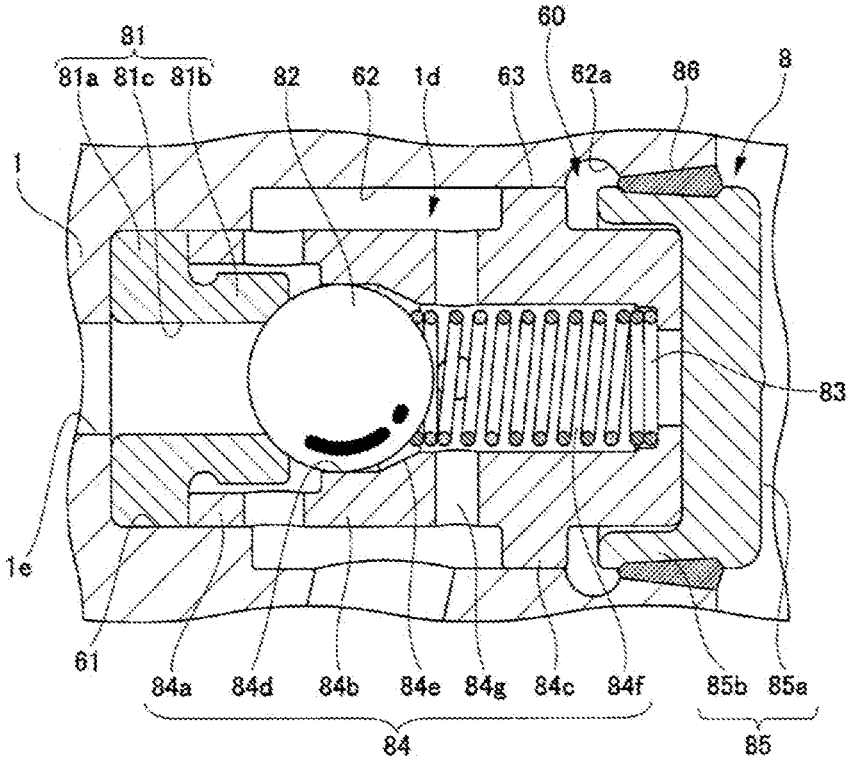
FIG. 5 is a cross-sectional view illustrating a discharge valve mechanism in the high-pressure fuel supply pump according to the first embodiment of the present invention.

FIG. 5 is a cross-sectional view illustrating the discharge valve mechanism 8 in the high-pressure fuel supply pump 100.

As illustrated in FIG. 3, the discharge valve mechanism 8 is connected to an outlet side of the pressurizing chamber 11. The discharge valve mechanism 8 includes a discharge valve seat member 81 and a discharge valve 82 that comes into contact with and separates from the discharge valve seat member 81. The discharge valve mechanism 8 includes a discharge valve spring 83 that biases the discharge valve 82 toward the discharge valve seat member 81, a discharge valve stopper 84 that determines a lift amount (movement distance) of the discharge valve 82, and a plug 85 that locks movement of the discharge valve stopper 84.

As illustrated in FIG. 5, the discharge valve seat member 81, the discharge valve 82, the discharge valve spring 83, and the discharge valve stopper 84 are housed in a discharge valve chamber 1*d* formed in the body 1. The body 1 is a specific example of a main body portion according to the present invention, and the discharge valve chamber 1*d* is a specific example of a valve chamber according to the present invention. The discharge valve stopper 84 is a specific example of a regulating member according to the present invention, and the plug 85 is a specific example of a sealing member according to the present invention.

The discharge valve chamber 1*d* is a substantially columnar space extending in the horizontal direction. One end of the discharge valve chamber 1*d* communicates with the pressurizing chamber 11 via the fuel passage 1*e*, and the other end of the discharge valve chamber 1*d* opens to the side surface of the body 1. The discharge valve chamber 1*d* has a small-diameter portion 61 on the pressurizing chamber 11 side and a large-diameter portion 62 on the opening side. An annular groove 62*a* continuous in the circumferential direction is formed in the large-diameter portion 62 of the discharge valve chamber 1*d*.

The discharge valve seat member 81 is formed in a substantially cylindrical shape, and includes a fixing portion 81*a* press-fitted into the small-diameter portion 61 of the discharge valve chamber 1*d* and a seat portion 81*b* continuous with the fixing portion 81*a*. The fixing portion 81*a* on the side opposite to the seat portion 81*b* forms one end in the axial direction of the discharge valve seat member 81, and abuts on the inner wall surface of the discharge valve chamber 1*d*. An outer diameter of the seat portion 81*b* is set to be smaller than an outer diameter of the fixing portion 81*a*, and an appropriate gap is formed between the outer peripheral surface of the seat portion 81*b* and the inner peripheral surface of the small-diameter portion 61 in the discharge valve chamber 1*d*.

A side of the seat portion 81*b* opposite to the fixing portion 81*a* forms the other end of the discharge valve seat member 81 in the axial direction, and is a seat surface on which the discharge valve 82 is seated. A tubular hole of the discharge valve seat member 81 is a fuel passage 81*c* through which the fuel flowing from the pressurizing chamber 11 passes, and faces the fuel passage 1*e*. A diameter of the fuel passage 81*c* is set to be substantially the same as a diameter of the fuel passage 1*e*. The discharge valve 82 is a sphere, and a diameter of the discharge valve 82 is set to be larger than a diameter of the fuel passage 81*c*.

The discharge valve stopper 84 is formed in a substantially cylindrical shape having the same outer diameter as the fixing portion 81*a* of the discharge valve seat member 81, and includes a fitting portion 84*a*, a guide portion 84*b*, and a gap forming portion 84*c*. The fitting portion 84*a* shows a specific example of a positioning portion according to the present invention. The fitting portion 84*a* forms one end portion in the axial direction of the discharge valve stopper 84, and is press-fitted into the small-diameter portion 61 of the discharge valve chamber 1*d*. In a state where the fitting portion 84*a* is press-fitted into the small-diameter portion 61 of the discharge valve chamber 1*d*, an axial center of the discharge valve stopper 84 coincides with an axial center of the discharge valve seat member 81 fixed to the small-diameter portion 61.

An end surface of the fitting portion 84*a* (one end in the axial direction of the discharge valve stopper 84) abuts on the fixing portion 81*a* of the discharge valve seat member 81. As a result, the axial movement of the discharge valve stopper 84 is restricted, and the discharge valve stopper 84 is positioned with respect to the discharge valve seat member 81. The seat portion 81*b* of the discharge valve seat member 81 is inserted inside the fitting portion 84*a*.

The guide portion 84*b* forms an intermediate portion in the axial direction of the discharge valve stopper 84, and includes a guide surface 84*d* that guides the discharge valve 82 in the axial direction inside the guide portion. Further, the guide portion 84*b* has a tapered surface 84*e* continuous with the guide surface 84*d*, and the discharge valve 82 comes into contact with a tapered surface 84*e* to limit the lift amount of the discharge valve 82. Therefore, the lift amount of the discharge valve 82 can be appropriately set by setting the position of the discharge valve stopper 84 with respect to the discharge valve seat member 81.

In the axial direction of the discharge valve stopper 84, an internal space 84*f* whose volume increases and decreases with the movement of the discharge valve 82 is formed on the other end side of the discharge valve 82. The discharge valve spring 83 is disposed in the internal space 84*f*. The discharge valve spring 83 biases the discharge valve 82 toward the seat portion 81*b* side (valve closing direction) of the discharge valve seat member 81.

A plurality of flow paths 84*g* extending in the radial direction are provided at the other axial end of the discharge valve stopper 84. One end of the flow path 84*g* communicates with the internal space 84*f*, and the other end of the flow path 84*g* opens to the outer peripheral surface of the discharge valve stopper 84. As a result, the internal space 84*f* communicates with the discharge valve chamber 1*d* via the flow path 84*g*. As a result, a fluid resistance accompanying the movement of the discharge valve 82 can be reduced, and an on-off operation of the discharge valve mechanism 8 can be quickly performed.

The gap forming portion 84*c* protrudes from the outer peripheral surface at the other end portion in the axial direction of the discharge valve stopper 84 and is continuous in the circumferential direction of the discharge valve stopper 84. An outer diameter of the gap forming portion 84*c* is set to be slightly smaller than a diameter of the large-diameter portion 62 in the discharge valve chamber 1*d*. Therefore, an annular gap 63 is formed between the gap forming portion 84*c* and the large-diameter portion 62 of the discharge valve chamber 1*d*. An outer diameter of the gap forming portion 84*c* is larger than an outer diameter of the fitting portion 84*a*.

The plug 85 is formed in a bottomed tubular shape, and includes a bottom portion 85*a* and a tubular portion 85*b*. The plug 85 is joined to the body 1 by the welded portion 86 in a state where the tubular portion 85*b* is inserted into the opening of the discharge valve chamber 1*d*, and blocks the fuel in the discharge valve chamber 1*d* so as not to leak to the outside of the body 1. The welded portion 86 is provided between an outer peripheral surface of the tubular portion 85*b* and an inner peripheral surface on the opening side of the discharge valve chamber 1*d*.

The bottom portion 85*a* of the plug 85 abuts on the other axial end of the discharge valve stopper 84. As a result, the plug 85 locks the movement of the discharge valve stopper 84 in the axial direction. Since the fitting portion 84*a* of the discharge valve stopper 84 abuts on the fixing portion 81*a* of the discharge valve seat member 81, the plug 85 locks the movement of the discharge valve seat member 81 in the axial direction via the discharge valve stopper 84.

As illustrated in FIG. 3, a discharge joint 12 is joined to the body 1 by a welded portion 12*b*. The discharge joint 12 has the fuel discharge port 12*a*, and the fuel discharge port 12*a* communicates with the discharge valve chamber 1*d* via the discharge passage 1*f* extending in the horizontal direction inside the body 1. The fuel discharge port 12*a* of the discharge joint 12 is connected to the common rail 106.

In a state where the fuel pressure in the pressurizing chamber 11 is lower than the fuel pressure in the discharge valve chamber 1*d*, the discharge valve 82 is pressed against the seat portion 81*b* of the discharge valve seat member 81 by the differential pressure acting on the discharge valve 82 and the biasing force of the discharge valve spring 83, and the discharge valve mechanism 8 is closed. Meanwhile, when the fuel pressure in the pressurizing chamber 11 becomes larger than the fuel pressure in the discharge valve chamber 1*d* and the differential pressure acting on the discharge valve 82 becomes larger than the biasing force of the discharge valve spring 83, the discharge valve 82 is separated from the seat portion 81*b* of the discharge valve seat member 81, and the discharge valve mechanism 8 is opened.

When the discharge valve mechanism 8 performs an on-off valve operation, fuel is taken into and out of the internal space 84*f*. Then, the fuel discharged from the internal space 84*f* is discharged from the discharge valve mechanism 8 to the discharge passage 1*f*. As a result, the high-pressure fuel in the pressurizing chamber 11 is discharged to the common rail 106 (see FIG. 1) via the discharge valve chamber 1*d*, the discharge passage 1*f* (see FIG. 3), and the fuel discharge port 12*a* (see FIG. 3) of the discharge joint 12. With the above configuration, the discharge valve mechanism 8 functions as a check valve that restricts the flowing direction of the fuel.

Both the discharge valve seat member 81 and the discharge valve stopper 84 of the discharge valve mechanism are press-fitted and fixed to the body 1, so that coaxiality between the seat portion 81*b* of the discharge valve seat member 81 and the guide portion 84*b* of the discharge valve stopper 84 can be secured. As a result, the discharge valve 82 can be steadily seated on the discharge valve seat portion of the discharge valve seat member 81, and backflow of fuel can be suppressed. As the discharge valve mechanism according to the present invention, the discharge valve seat member 81 may be press-fitted into the discharge valve stopper 84 according to conditions such as an assembly order, and both may be press-fitted and fixed to the body 1 as an integrated component.

The position of the discharge valve stopper 84 in the axial direction is determined by the fitting portion 84*a* abutting on the fixing portion 81*a* of the discharge valve seat member 81. With this structure, it is possible to prevent the discharge valve 82 from being excessively lifted (to regulate the lift amount) using the discharge valve stopper 84, and it is possible to realize a highly responsive discharge valve mechanism having a short return time (valve closing time) of the discharge valve 82.

In addition, by using the discharge valve stopper 84 and the plug 85 as separate members, it is possible to select a material according to each part. For example, the discharge valve stopper 84 may be made of highly advanced martensitic stainless steel that can withstand the sliding load and collision load of the discharge valve 82, and the plug 85 may be made of ferrite or austenitic stainless steel in consideration of weldability.

The discharge valve stopper 84 and the plug 85 may be one member. In the discharge valve stopper 84, the guide surface 84*d* and the tapered surface 84*e* may be formed as separate members. In this case, it is necessary to apply high-hardness martensitic stainless steel that can withstand the collision of the discharge valve 82 to the member including the tapered surface 84*e*, but a material having hardness lower than that of the member including the tapered surface 84*e* may be applied to the member including the guide surface 84*d* due to a weak sliding load.

Next, a method of joining the plug 85 and the body 1 will be described. In order to prevent the fuel inside the high-pressure fuel supply pump 100 from leaking to the outside, it is necessary to sufficiently secure the reliability of the joint portion between the plug 85 and the body 1. That is, it is necessary to ensure sufficient strength of the welded portion 86 which is the joint portion between the plug 85 and the body 1.

As illustrated in FIG. 5, in the discharge valve chamber 1*d* of the high-pressure fuel supply pump 100, an annular space portion 64 surrounded by the welded portion 86, the body 1, the discharge valve stopper 84, and the plug 85 is formed. The annular space portion 64 is an annular space portion continuous along the outer peripheral surface of the discharge valve stopper 84.

The plug 85 is inserted into the discharge valve chamber 1*d* of the body 1 until the bottom portion 85*a* abuts on the discharge valve stopper 84, and the welded portion 86 is welded and fixed. At this time, the plug 85 is preferably press-fitted into the discharge valve chamber 1*d*. By press-fitting the plug 85 into the discharge valve chamber 1*d*, the welding surfaces stably come into contact with each other, and the welding quality can be improved.

In this state, the boundary surfaces of the plug 85 and the body 1 are joined by the laser beam, welding is performed on the welded portion 86 and the entire outer periphery of the tubular portion 85*b* in the plug 85, and the fuel inside the discharge valve chamber 1*d* is sealed. At this time, when the annular space portion 64 is a closed space, the air in the annular space portion 64 expands due to the thermal influence of welding. As a result, an underfill in which the welded portion 86 is recessed is generated, and there is a possibility that the shape of the welded portion 86 is not stabilized. As a result, since the shape of the welded portion 86 is not stable, the variation in welding strength increases, and there is a possibility that welding quality is deteriorated.

Therefore, in the discharge valve mechanism 8 of the present embodiment, the annular gap 63 is provided between the gap forming portion 84*c* of the discharge valve stopper 84 and the large-diameter portion 62 of the discharge valve chamber 1*d*. The annular gap 63 communicates with the annular space portion 64, and as a result, the annular space portion 64 and a space closer to the pressurizing chamber 11 (fitting portion 84*a*) than the gap forming portion 84*c* communicate with each other.

Therefore, the air expanded in the annular gap 63 due to the thermal influence of welding can be released to the space on the pressurizing chamber 11 (fitting portion 84*a*) side of the gap forming portion 84*c* via the annular gap 63. As a result, the generation of the underfill can be suppressed, the variation in the welding strength can be suppressed, and the deterioration in the welding quality can be prevented.

Since the annular gap 63 has an annular shape along the outer peripheral surface of the gap forming portion 84*c*, even when welding spatter adheres to a part of the annular gap 63, the expanded air can be released from the other part. As described above, according to the present embodiment, the expanded air can be released even when the welding spatter occurs, and the welding quality can be improved while suppressing the mixture of the welding spatter into the discharge valve chamber 1*d* through which the fuel flows and the discharge joint 12.

Further, by appropriately setting the inner diameter of the large-diameter portion 62 and the outer diameter of the gap forming portion 84*c* in the discharge valve chamber 1*d*, a radial width of the annular gap 63 is managed, so that it is possible to suppress mixing of welding spatter into the discharge valve chamber 1*d*. For example, when the radial width of the annular gap 63 is set to 0.1 mm or less, spatters larger than 0.1 mm in diameter cannot pass through the annular gap 63. As a result, it is possible to prevent spatter having a diameter of more than 0.1 mm from being mixed into the discharge valve chamber 1*d* or the discharge joint 12.

[Operation of High-Pressure Fuel Pump]

Next, the operation of the high-pressure fuel pump according to the present embodiment will be described.

When the plunger 2 illustrated in FIG. 1 is lowered and the electromagnetic suction valve mechanism 3 is opened, the fuel flows from the suction passage 1*a* into the pressurizing chamber 11. Hereinafter, the downward stroke of the plunger 2 is referred to as the intake stroke. Meanwhile, when the plunger 2 is raised and the electromagnetic suction valve mechanism 3 is closed, the fuel in the pressurizing chamber 11 is pressurized, passes through the discharge valve mechanism 8, and is pressure-fed to the common rail 106 (see FIG. 1). Hereinafter, the stroke of raising the plunger 2 is referred to as a compression stroke.

As described above, when the electromagnetic suction valve mechanism 3 is closed during the compression stroke, the fuel sucked into the pressurizing chamber 11 during the intake stroke is pressurized and discharged to the common rail 106 side. Meanwhile, when the electromagnetic suction valve mechanism 3 is opened during the compression stroke, the fuel in the pressurizing chamber 11 is pushed back toward the suction passage 1*a* side and is not discharged toward the common rail 106 side. In this manner, the fuel discharge by the high-pressure fuel supply pump 100 is operated by opening and closing the electromagnetic suction valve mechanism 3. The opening and closing of the electromagnetic suction valve mechanism 3 is controlled by the ECU 101.

In the intake stroke, the volume of the pressurizing chamber 11 increases, and the fuel pressure in the pressurizing chamber 11 decreases. In this intake stroke, when the fuel pressure in the pressurizing chamber 11 becomes lower than the pressure in the suction port 31*b* (see FIG. 4) and the biasing force due to the differential pressure therebetween exceeds the biasing force by the valve biasing spring 38, the suction valve 32 is separated from the seating portion 31*a*, and the electromagnetic suction valve mechanism is opened. As a result, the fuel passes between the suction valve 32 and the seating portion 31*a*, passes through a plurality of holes provided in the stopper 37, and flows into the pressurizing chamber 11.

After the intake stroke is completed, the process proceeds to the compression stroke. At this time, the electromagnetic coil 35 remains in a non-energized state, and no magnetic attraction force acts between the anchor 36 and the magnetic core 39. The rod biasing spring 34 is set to have a biasing force necessary and sufficient to maintain the suction valve 32 at the valve opening position away from the seating portion 31*a* in the non-energized state.

In this state, even when the plunger 2 moves upward, the rod 33 remains at the valve opening position, so that the suction valve 32 biased by the rod 33 also remains at the valve opening position. Therefore, the volume of the pressurizing chamber 11 decreases with the upward movement of the plunger 2, but in this state, the fuel once sucked into the pressurizing chamber 11 is returned to the suction passage 10*b* through the electromagnetic suction valve mechanism 3 in the valve opening state again, and the pressure inside the pressurizing chamber 11 does not increase. This stroke is referred to as the return stroke.

In the return process, when a control signal from the ECU 101 (see FIG. 1) is applied to the electromagnetic suction valve mechanism 3, a current flows through the electromagnetic coil 35 via the terminal member 30. When a current flows through the electromagnetic coil 35, a magnetic attraction force acts on the magnetic core 39 and the magnetic attraction surface S of the anchor 36, and the anchor 36 is attracted to the magnetic core 39. When the magnetic attraction force becomes larger than the biasing force of the rod biasing spring 34, the anchor 36 moves toward the magnetic core 39 side against the biasing force of the rod biasing spring 34, and the rod 33 engaged with the anchor 36 moves in a direction away from the suction valve 32. As a result, the suction valve 32 is seated on the seating portion 31*a* by the biasing force of the valve biasing spring 38 and the fluid force caused by the fuel flowing into the suction passage 10*b*, and the electromagnetic suction valve mechanism 3 is closed.

After the electromagnetic suction valve mechanism 3 is closed, the fuel in the pressurizing chamber 11 is pressurized as the plunger 2 is raised, and when the pressure becomes equal to or more than the pressure of the fuel discharge port 12*a*, the fuel passes through the discharge valve mechanism 8 and is discharged to the common rail 106 (see FIG. 1). This stroke is referred to as a discharge process. That is, the compression stroke between the lower start point and the upper start point of the plunger 2 includes the return stroke and the discharge stroke. By controlling the timing of energizing the electromagnetic coil 35 of the electromagnetic suction valve mechanism 3, the amount of high-pressure fuel to be discharged can be controlled.

When the timing of energizing the electromagnetic coil 35 is made earlier, the ratio of the return stroke during the compression stroke becomes smaller, and the ratio of the discharge stroke becomes larger. That is, the fuel returned to the suction passage 10*b* decreases, and the fuel discharged at high pressure increases. Meanwhile, when the timing of energizing the electromagnetic coil 35 is delayed, the ratio of the return stroke during the compression stroke increases, and the ratio of the discharge stroke decreases. As a result, the amount of fuel returned to the suction passage 10*b* increases, and the amount of fuel discharged at a high pressure decreases. As described above, by controlling the timing of energizing the electromagnetic coil 35, the amount of fuel discharged at high pressure can be controlled to an amount required by the engine (internal combustion engine).

2. Second Embodiment

Next, a high-pressure fuel supply pump according to a second embodiment of the present invention will be described with reference to FIG. 6. The high-pressure fuel supply pump according to the second embodiment has the same configuration as the high-pressure fuel supply pump 100 according to the first embodiment, and only a discharge valve mechanism 108 is different. Therefore, here, the configuration of the discharge valve mechanism 108 will be described, and the description of the configuration common to the high-pressure fuel supply pump 100 will be omitted.

Figure 6:
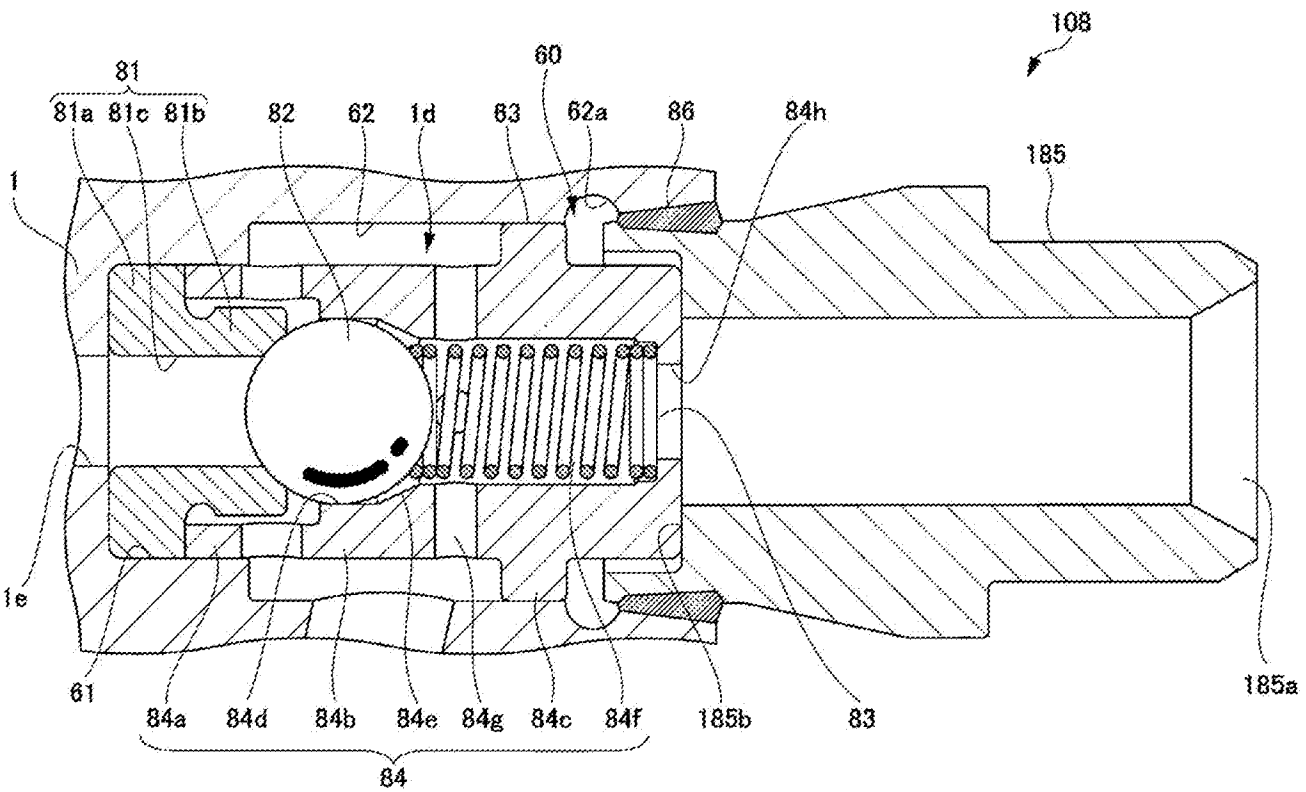
FIG. 6 is a cross-sectional view illustrating a discharge valve mechanism in a high-pressure fuel supply pump according to a second embodiment of the present invention.

FIG. 6 is a cross-sectional view illustrating the discharge valve mechanism in the high-pressure fuel supply pump according to the second embodiment.

The discharge valve mechanism 108 according to the second embodiment is connected to an outlet side of a pressurizing chamber 11 similarly to the discharge valve mechanism 8 according to the first embodiment. The discharge valve mechanism 108 includes a discharge valve seat member 81 and a discharge valve 82 that comes into contact with and separates from the discharge valve seat member 81. The discharge valve mechanism 108 includes a discharge valve spring 83 that biases the discharge valve 82 toward the discharge valve seat member 81, a discharge valve stopper 84 that determines a lift amount (movement distance) of the discharge valve 82, and a plug 185 that locks movement of the discharge valve stopper 84.

Since the discharge valve seat member 81, the discharge valve 82, the discharge valve spring 83, and the discharge valve stopper 84 are the same as those of the discharge valve mechanism 8 according to the first embodiment, redundant description will be omitted. The plug 185 shows another specific example of a sealing member according to the present invention.

The plug 185 is formed in a substantially tubular shape, has one axial end joined to a body 1, and has a fuel discharge port 185*a* at the other axial end. That is, the plug 185 also serves as a discharge joint for discharging fuel. Therefore, in the second embodiment, the number of components of the high-pressure fuel supply pump can be reduced. In the discharge valve mechanism 108 according to the second embodiment, since the body 1 is not interposed between the discharge joint (plug 185) and the discharge valve mechanism 108, the body 1 according to the second embodiment is not provided with a discharge passage 1*f* (see FIG. 3).

The fuel discharge port 185*a* of the plug 185 is connected to a common rail 106 (see FIG. 1). In the discharge valve mechanism 108, the fuel that has entered the internal space 84*f* of the discharge valve stopper 84 passes through a flow path 84*h* provided in the discharge valve stopper 84, passes through the inside of the plug 185, passes through the fuel discharge port 185*a*, and is discharged to the common rail 106 (see FIG. 1).

The plug 185 is joined to the body 1 by a welded portion 86 in a state where one end in the axial direction is inserted into the opening of the discharge valve chamber 1*d*. The welded portion 86 is provided between the outer peripheral surface at one axial end of the plug 185 and the inner peripheral surface on the opening side of the discharge valve chamber 1*d*.

A recess 185*b* recessed in the axial direction is formed at one axial end of the plug 185. The recess 185*b* is formed in an annular shape surrounding the tubular hole of the plug 185. A bottom surface of the recess 185*b* abuts on the discharge valve stopper 84. As a result, the plug 185 locks the movement of the discharge valve stopper 84 in the axial direction. Since a fitting portion 84*a* of the discharge valve stopper 84 abuts on a fixing portion 81*a* of the discharge valve seat member 81, the plug 185 locks the movement of the discharge valve seat member 81 in the axial direction via the discharge valve stopper 84. As described above, the plug 185 locks the movements of the discharge valve seat member 81 and the discharge valve stopper 84 in the axial direction, and discharges the fuel from the fuel discharge port 185*a*.

Also in the discharge valve mechanism 108, similarly to the discharge valve mechanism 8 according to the first embodiment, an annular gap 63 is provided between the gap forming portion 84*c* of the discharge valve stopper 84 and the large-diameter portion 62 of the discharge valve chamber 1*d*. Therefore, the air expanded in the annular gap 63 due to the thermal influence of welding can be released to the space on the pressurizing chamber 11 (fitting portion 84*a*) side of the gap forming portion 84*c* via the annular gap 63. As a result, the generation of the underfill can be suppressed, the variation in the welding strength can be suppressed, and the deterioration in the welding quality can be prevented. In addition, even when welding spatter occurs, expanded air can be released, and welding quality can be improved while mixing of welding spatter into the discharge valve chamber 1*d* through which fuel flows is suppressed.

2. Summary

As described above, the high-pressure fuel supply pump 100 (fuel supply pump) according to the first embodiment described above includes the discharge valve stopper 84 (regulating member), the body 1 (main body portion), the plug 85 (sealing member), and the welded portion 86 (welded portion). The discharge valve stopper 84 guides the movement of the discharge valve 82 (valve body) or regulates the movement distance of the discharge valve 82. The body 1 is provided with the discharge valve chamber 1*d* (valve chamber) that houses the discharge valve stopper 84 and is opened to the outside. The plug 85 seals the discharge valve chamber 1*d*. The welded portion 86 fixes the plug 85 to the body 1. The annular space portion 60 (annular space portion) along the outer periphery of the discharge valve stopper 84 is formed between the welded portion 86 and the discharge valve stopper 84. The discharge valve stopper 84 includes the fitting portion 84*a* (positioning portion) for positioning with respect to the body 1 on the side opposite to the plug 85, and the gap forming portion 84*c* (gap forming portion) forming the annular gap 63 (annular gap) with the body 1. The annular gap 63 allows the space on the fitting portion 84*a* side in the discharge valve chamber 1*d* and the annular space portion 60 to communicate with each other.

Accordingly, the air expanded in the annular gap 63 due to the thermal influence of welding can be released through the annular gap 63. As a result, generation of an underfill in the welded portion 86 can be suppressed, and variations in welding strength can be suppressed to prevent deterioration in welding quality. That is, it is possible to improve the quality of welding while securing the function of the discharge valve 82. In addition, by providing the annular gap 63 which is an annular gap, even when welding spatter is generated and adheres to a part of the annular gap 63, the expanded air can be released, and the welding quality can be improved while suppressing mixing of welding spatter into the discharge valve chamber 1*d* through which fuel flows.

The annular gap 63 (annular gap) of the high-pressure fuel supply pump 100 (fuel supply pump) according to the first embodiment described above is formed such that the distance between the discharge valve stopper 84 (regulating member) and the body 1 (main body portion) is 0.1 mm or less. Accordingly, the spatter having a diameter of more than 0.1 mm cannot pass through the annular gap 63. As a result, it is possible to prevent spatter having a diameter of more than 0.1 mm from being mixed into the discharge valve chamber 1*d*.

The discharge valve stopper 84 (regulating member) and the plug 85 (sealing member) of the high-pressure fuel supply pump 100 (fuel supply pump) according to the first embodiment described above are configured as separate components.

As a result, it is possible to select a material according to each portion.

The plug 185 (sealing member) of the high-pressure fuel supply pump (fuel supply pump) according to the second embodiment described above is formed integrally with a discharge joint through which fuel is discharged when the discharge valve 82 (valve body) is opened. As a result, the number of components of the high-pressure fuel supply pump 100 can be reduced.

The high-pressure fuel supply pump 100 (fuel supply pump) according to the first embodiment described above includes the discharge valve seat member 81 (seat member). The discharge valve seat member 81 is disposed on the side opposite to the plug 85 (sealing member) of the discharge valve stopper 84 (regulating member), and the discharge valve (valve body) is seated. The discharge valve seat member 81 is fixed to the body 1 (main body portion). As a result, since both the discharge valve seat member 81 and the discharge valve stopper 84 (regulating member) are positioned with respect to the body 1 (main body portion), the discharge valve stopper 84 can be positioned with respect to the discharge valve seat member 81 with high accuracy, and the discharge valve 82 can be steadily seated on the discharge valve seat member 81.

The high-pressure fuel supply pump 100 (fuel supply pump) according to the first embodiment described above includes the discharge valve seat member 81 (seat member). The discharge valve seat member 81 is disposed on the side opposite to the plug 85 (sealing member) of the discharge valve stopper 84 (regulating member), and the discharge valve (valve body) is seated. The discharge valve seat member 81 may be fixed to the discharge valve stopper 84. As a result, the discharge valve stopper 84 can be positioned with respect to the discharge valve seat member 81 with high accuracy, and the discharge valve 82 can be steadily seated on the discharge valve seat member 81. In addition, since the discharge valve seat member 81 and the discharge valve stopper 84 can be inserted into the discharge valve chamber 1*d* (valve chamber) in an integrally assembled state, the assembling operation of the high-pressure fuel supply pump 100 can be facilitated.

The discharge valve stopper 84 (regulating member) of the high-pressure fuel supply pump 100 (fuel supply pump) according to the first embodiment described above is sandwiched between the discharge valve seat member 81 (seat member) and the plug 85 (sealing member), and the movement of the discharge valve 82 (valve body) in the direction along the moving direction is locked. As a result, the relative position between the discharge valve stopper 84 and the discharge valve seat member 81 can be prevented from being changed, and the lift amount (movement distance) of the discharge valve 82 can be regulated with high accuracy.

The fitting portion 84*a* (positioning portion) in the discharge valve stopper 84 (regulating member) of the high-pressure fuel supply pump 100 (fuel supply pump) according to the first embodiment described above is fixed to the body 1 (main body portion). As a result, the fitting portion 84*a* serves as a fixing portion with respect to the body 1 in addition to the positioning portion of the discharge valve stopper 84 with respect to the body 1, and the shape of the discharge valve stopper 84 can be simplified. In addition, the movement of the discharge valve stopper 84 can be more firmly prevented.

In addition, the gap forming portion 84*c* (gap forming portion) of the high-pressure fuel supply pump 100 (fuel supply pump) according to the first embodiment described above protrudes from the outer peripheral portion of the discharge valve stopper 84 (regulating member) and is formed in a continuous annular shape along the outer peripheral portion of the discharge valve stopper 84. As a result, the annular gap 63 (annular gap) can be formed with a simple structure. The annular gap 63 can be easily formed by inserting the discharge valve stopper 84 into the discharge valve chamber 1*d* (valve chamber).

In addition, the fitting portion 84*a* (positioning portion) of the high-pressure fuel supply pump 100 (fuel supply pump) according to the first embodiment described above is formed in a columnar shape to be fitted to the body (main body portion), and the outer diameter of the gap forming portion 84*c* (gap forming portion) is larger than the outer diameter of the fitting portion 84*a*. As a result, the discharge valve stopper 84 can be easily inserted into the discharge valve chamber 1*d* (valve chamber) from the end portion on the fitting portion 84*a* side, and the assembling operation of the high-pressure fuel supply pump 100 can be facilitated.

The embodiments of the high-pressure fuel supply pump of the present invention are described above including the operational effects thereof. However, the high-pressure fuel supply pump of the present invention is not limited to the above-described embodiments, and various modifications can be made without departing from the gist of the invention described in the claims.

For example, the embodiments are described in detail for the purpose of clearly explaining the present invention, and is not necessarily limited to those including all the configurations described. Further, it is possible to replace a portion of the configuration of one embodiment with the configuration of another embodiment, and it is also possible to add the configuration of another embodiment to the configuration of one embodiment. Further, it is possible to perform addition/deletion/replacement on other configurations with respect to a portion of the configurations of each embodiment.

For example, in the first and second embodiments described above, the plug 85 (185) is fixed to the body 1 by laser welding. However, the welding for fixing the sealing member according to the present invention to the main body portion is not limited to the laser welding, and may be any welding such as arc welding or gas welding as long as the welding method causes air expansion due to welding heat.

In the first and second embodiments described above, the fitting portion 84*a*, which is a specific example of the positioning portion, is press-fitted and fixed to the small-diameter portion 61 of the discharge valve chamber 1*d*. However, the positioning portion according to the present invention is not limited to being fixed to the main body portion (body 1), and may have a function of positioning the regulating member (discharge valve stopper 84) with respect to the main body portion. As the regulating member according to the present invention, for example, a portion having a function of positioning with respect to the main body portion and a portion having a function of fixing with respect to the main body portion may be separately provided, or may be fixed to the main body portion via another member.

REFERENCE SIGNS LIST

1 body
1*a* suction passage
1*b* flange
1*c* fixing portion
1*d* discharge valve chamber
1*e* fuel passage
1*f* discharge passage
2 plunger
3 electromagnetic suction valve mechanism
4 relief valve mechanism
5 suction joint
6 cylinder
8, 108 discharge valve mechanism
9 pressure pulsation reduction mechanism
10 low-pressure fuel chamber
11 pressurizing chamber
12 discharge joint
12*a* fuel discharge port
12*b* welded portion
14 damper cover
15 retainer
17 seal holder
17*a* auxiliary chamber
18 plunger seal
60 annular space portion
61 small-diameter portion
62 large-diameter portion
62*a* annular groove
63 annular gap
64 annular space portion
81 discharge valve seat member
81*a* fixing portion
81*b* seat portion
81*c* fuel passage
82 discharge valve
84 discharge valve stopper
84*a* fitting portion
84*b* guide portion
84*c* gap forming portion
84*d* guide surface
84*e* tapered surface
84*f* internal space
84*g* flow path
84*h* flow path
85, 185 plug
85*a* bottom portion
85*b* tubular portion
86 welded portion
90 fuel pump attachment portion
91 cam
92 tappet
93 O-ring
100 high-pressure fuel supply pump
101 ECU
102 feed pump
103 fuel tank
104 low-pressure pipe
105 fuel pressure sensor
106 common rail
107 injector
185*a* fuel discharge port
185*b* recess
200 fuel supply system

The invention claimed is:

1. A fuel supply pump, comprising:

a regulating member that guides a valve body or regulates a movement distance of the valve body;

a main body portion provided with a valve chamber that houses the regulating member;

a sealing member that seals the valve chamber and locks the regulating member from movement in the valve chamber relative to the main body portion; and a welded portion that fixes the sealing member to the main body portion, wherein an annular space portion along an outer periphery of the regulating member is formed between the welded portion and the regulating member, the regulating member includes a positioning portion for positioning with respect to the main body portion on a side opposite to the sealing member, and a gap forming portion forming an annular gap between the gap forming portion and the main body portion, and the annular gap allows a space on a side of the positioning portion in the valve chamber and the annular space portion to communicate with each other.

2. The fuel supply pump according to claim 1, wherein the annular gap is formed such that a distance between the regulating member and the main body portion is 0.1 mm or less.

3. The fuel supply pump according to claim 1, wherein the regulating member and the sealing member are configured as separate components.

4. The fuel supply pump according to claim 3, wherein the sealing member is formed integrally with a discharge joint through which fuel is discharged when the valve body is opened.

5. The fuel supply pump according to claim 1, further comprising a seat member which is disposed on a side of the regulating member opposite to the sealing member and on which the valve body is seated, wherein the seat member is fixed to the main body portion.

6. The fuel supply pump according to claim 1, further comprising a seat member which is disposed on a side of the regulating member opposite to the sealing member and on which the valve body is seated, wherein the seat member is fixed to the regulating member.

7. The fuel supply pump according to claim 5, wherein the regulating member is sandwiched between the seat member and the sealing member, and movement of the regulating member in a direction along a moving direction of the valve body is locked.

8. The fuel supply pump according to claim 1, wherein the positioning portion is fixed to the main body portion.

9. The fuel supply pump according to claim 1, wherein the gap forming portion is formed in an annular shape protruding from an outer peripheral portion of the regulating member and continuing along the outer peripheral portion of the regulating member.

10. The fuel supply pump according to claim 9, wherein the positioning portion is formed in a columnar shape to be fitted to the main body portion, and an outer diameter of the gap forming portion is larger than an outer diameter of the positioning portion.

11. The fuel supply pump according to claim 1, wherein the welded portion is provided between an outer peripheral surface of the sealing member and an inner peripheral surface of the valve chamber.

12. The fuel supply pump according to claim 1, wherein the sealing member abuts the regulating member and is not welded to the regulating member.

13. The fuel supply pump according to claim 1, wherein the sealing member has a tubular shaped body and wherein a portion of the regulating member is received within the tubular shaped body of the sealing member.

14. The fuel supply pump according to claim 13, wherein the welded portion is provided between an outer peripheral surface of the tubular shaped body and an inner peripheral surface of the valve chamber.

* * * * *